United States Patent [19]

Stoppacher

[11] 3,959,935

[45] June 1, 1976

[54] ABRASIVE PAD FOR GRINDING LENSES

[75] Inventor: Waldemar Stoppacher, Valhalla, N.Y.

[73] Assignee: Interoptic Laboratories, Inc., Elmsford, N.Y.

[22] Filed: Mar. 18, 1975

[21] Appl. No.: 559,444

[52] U.S. Cl. ..... 51/395; 51/406; 51/407; 51/DIG. 34

[51] Int. Cl.[2] ..... B24D 11/02

[58] Field of Search ..... 51/394, 395, 396, 397, 51/398, 401, 402, 405, 406, 407, DIG. 34

[56] References Cited

UNITED STATES PATENTS

| | | | |
|---|---|---|---|
| 2,286,208 | 6/1942 | Kirchner | 51/406 |
| 2,309,836 | 2/1943 | Fenton | 51/DIG. 34 |
| 2,607,174 | 8/1952 | Lanius | 51/284 |
| 2,701,191 | 2/1955 | Laliberte | 51/DIG. 34 |
| 3,144,737 | 8/1964 | Faas | 51/DIG. 34 |
| 3,267,623 | 8/1966 | Block | 51/406 |
| 3,324,608 | 6/1967 | Hoenig | 51/395 |
| 3,583,111 | 6/1971 | Volk | 51/DIG. 34 |
| 3,699,721 | 10/1972 | Beasley | 51/DIG. 34 |

*Primary Examiner*—Al Lawrence Smith
*Assistant Examiner*—Nicholas P. Godici

[57] ABSTRACT

A pad for grinding lens blanks comprising a pliable sheet of a water-proof material (e.g., paper or fabric) with an adhesive coating on one side thereof for adhering onto a working surface. An abrasive substance (e.g., silicon carbide) is applied to the pad and a plurality of radially extending channels are cut through its area to provide a smooth fit over a working surface.

2 Claims, 3 Drawing Figures

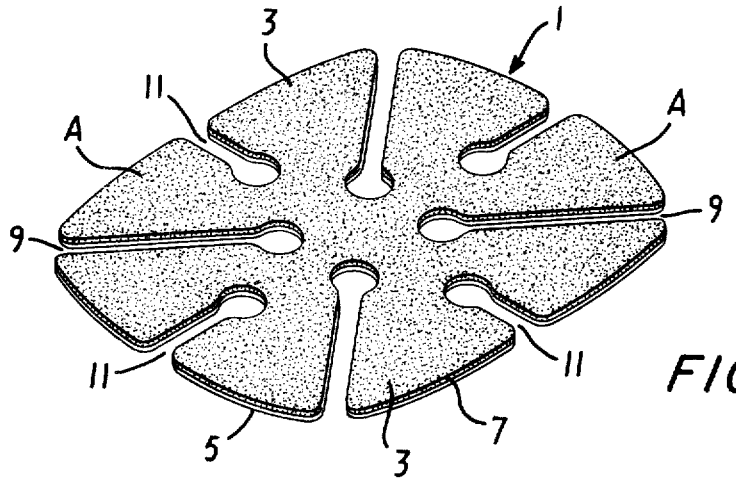
FIG. 1
FIG. 2
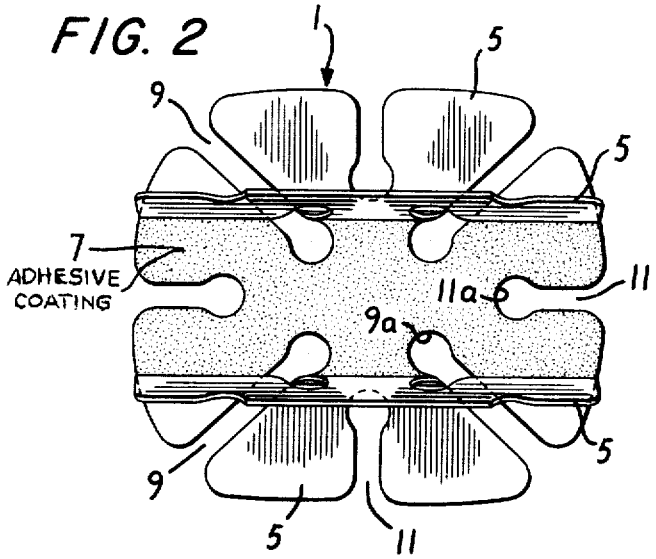
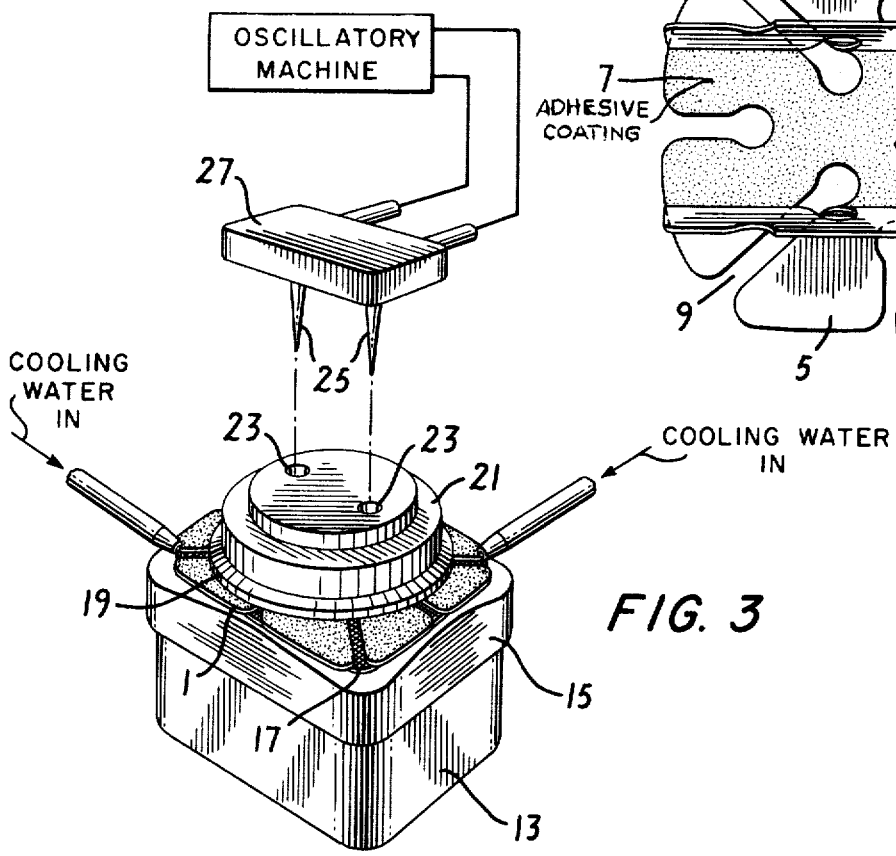
FIG. 3

ABRASIVE PAD FOR GRINDING LENSES

BACKGROUND OF INVENTION

1. Field of Invention

The present invention relates to grinding optical lenses, and is particularly related to improvements in grinding pads used for grinding optical and opthalmic lenses. More specifically, this invention is concerned with an abrasive pad which is uniquely suitable for grinding optical and opthalmic lenses without the aid of an abrasive slurry during the grinding operation.

2. Description of the Prior Art

Grinding of optical and opthalmic lenses are well known in the art, and indeed there are several patents and publications which essentially describe the present day methods of grinding such lenses. Basically these methods comprise grinding a lens blank to a precise and predetermined curvature in order to impart the required optical characteristics to the finished lens. A typical prior art method, for example, is described in U.S. Pat. No. 3,699,721 issued on Oct. 24, 1972. According to this patent the grinding operation is performed by the use of a cast iron tool with a lapping surface having a curvature which corresponds precisely to the desired curvature to be impressed upon the lens blank. An oscillatory motion, or a combination of oscillatory and rotary motions is imparted between the lens blank and the lapping surface while a stream of an abrasive slurry is deposited over the lapping surface in order to grind the lens blank.

Other patents disclose grinding optical and opthalmic lenses using essentially the same procedure as described in the aforementioned patent, but employing variously designed pads adapted to conform to the curvature of the surface of a working tool. These pads which are interposed between the lens blank and the surface of the working tool provide a surface for a stream of abrasive slurry which is independently deposited on the tool surface. See, e.g., U.S. Pat. Nos. 2,886,923 and 3,144,737.

The principal disadvantage of the pads which have heretofore been used during the grinding of optical and opthalmic lenses is that notwithstanding their use, an abrasive slurry must be employed in order to effectively grind the lens blanks. The prior art pads generally consist of metallic foils of various configurations designed to conform to the curvature of the surface of the working tool and are by themselves ineffective for grinding the lens blanks, unless an independent source of an abrasive medium is employed. The use of abrasive slurry, however, for grinding of these lens blanks is both a costly and cumbersome operation. Accordingly, there is a need for a grinding pad for use in grinding lens blanks without the necessity for concommitant use of an abrasive slurry.

SUMMARY OF THE INVENTION

This invention provides an abrasive pad which is uniquely suited for grinding optical and opthalmic lenses without the aid of an abrasive slurry. The structural features of the abrasive pad of this invention as well as its composition will be more readily comprehended from the following detailed description of the invention taken in conjunction with the accompanying drawings, wherein like numerals are employed to designate like parts.

THE DRAWINGS

FIG. 1 is a perspective view of the abrasive pad of this invention;

FIG. 2 is a view of the abrasive pad of this invention illustrating the pealable underlayer, and the adhesive coating which serves to adhere the pad to a working surface, and FIG. 3 is a perspective view of a partial assembly employed during the grinding operation as will be more fully described in the ensuing description.

DETAILED DESCRIPTION OF THE INVENTION

Referring to the drawings, and more specifically to FIGS. 1 and 2, there is shown a pad 1 consisting of a pliable sheet 3 of a hydrophobic material such as a water-proof or water-resistant sheet of paper, polymer, cloth or non-woven textile fabric and the like, a pealable flexible underlayer 5 such as a wax impregnated paper which has the same geometrical configuration as the pliable sheet 3 and which is retained to said pliable sheet 3 by an adhesive coating 7 such as a water-proof pressure sensitive adhesive, glue or other adhesives of the usual type and variety which remain water-proof for a relatively long time.

In order to fit the pad 1 smoothly over a working surface (as will hereinafter be explained) the pliable sheet 3 and the underlayer 5 are formed with radially extending channels 9 and 11 with enlarged rounded inner ends 9*a* and 11*a* designed to eliminate any wrinkles when the pad is fitted over the surface of a working tool. The radially extending channels 9 and 11 which are of alternating equal lengths also serve to direct the cooling medium over the pad so as to eliminate any hot spots or overheating during the grinding operation.

It has been discovered that when an abrasive substance is properly applied to the pliable sheet 3, the resulting pad is uniquely suitable for grinding lens blanks with any degree of surface convexity (or concavity) without the use of an abrasive slurry as it has heretofore been customary in the prior art. It has further been discovered that the abrasive substance can be best applied to the pliable sheet 3 by first coating the pliable sheet with an appropriate bonding agent for the abrasive material. The choice of the bonding agent depends upon the particular abrasive substance which is employed, although, generally, glue, resins such as liquid phenolic or urea resin (which may be modified to give different curing times, strength, flexibility, or other desirable properties), latex and other liquid bonding agents which, after drying and curing, firmly bonds the particles of the abrasive substance together, can be satisfactorily used for the purpose of this invention. These bonding agents are well known in the art.

After coating the pliable sheet 3, and while the bonding agent is still in the fluid state, the abrasive substance is applied thereto in particulate forms and the mixture is cured at suitable curing temperatures. The abrasive substance may be applied to the liquid bonding agent by any known techinque such as spraying, etc. Thus, the pad is provided with a substantially uniform abrasive surface A composed of particulate forms of the abrasive substance firmly bonded together by a bonding matrix. The composite pad (including the abrasive substance-bonding matrix) is flexible and readily conformable to the curvature of a working surface and can withstand the grinding operation during the grinding of optical lenses, without chipping or disintegration.

It may be appreciated that the particles size of the abrasive substance can vary depending upon the nature of the abrasive substance, the desired fineness of the abrasive pad and its grinding efficiency. Since the bonding agent at least partially impregnates the pliable sheet 3 and furthermore, the abrasive particles also impregnate into the bonding agent to some extent, the pads of this invention are also referred to as abrasive impregnated pads.

It has further been discovered that pads with a silicon carbide (SiC) abrasive surface are particularly effective for grinding opthalmic lenses and hence the use of such pads constitutes a preferred embodiment of this invention. Other pads may be used in which the abrasive surface is made of other known abrasive materials, e.g., flint (quartz; $Si\ O_2$), Emery ($Al_2\ O_3$. FeO), Garnet ($Si\ O_2$. FeO complex with $Al_2\ O_3$), Crocus (FeO) and fused aluminum oxide.

The use of abrasive impregnated pad of this invention for grinding lens blanks may be illustrated by reference to FIG. 3 where there is shown a block 13 such as, e.g., a cast iron block and a convex working surface 15 rigidly retained by the block 13 (alternatively, the working surface may be concave if the curvature of the lens blanks so requires). A prepolishing pad 17 is fitted over the working surface 15 and the abrasive impregnated pad 1 is adhesively secured to the prepolishing pad 17 after pealing off the underlayer 5. Although the abrasive impregnated pad may be adhesively secured to the working surface 15, it is generally customary to employ a prepolishing pad for prepolishing the lens blanks after they have been ground with the abrasive impregnated pad. The prepolishing pad 17 is usually an interwoven water-proof fabric or paper of the usual type and variety which have heretofore been employed for prepolishing such lens blanks.

With further reference to FIG. 3, a lens blank 19 is slidably positioned on the abrasive impregnated pad 1 such that the concave surface of the lens blank is an intimate contact with the pad to thereby provide an effective grinding surface for the lens blank. The lens blank 19 is integrally secured to a rigid surface 21 having spaced apertures 23 adapted to be engaged by the pins 25 which are affixed to a plate member 27 which is connected to an oscillating machine (shown in block) capable of imparting oscillatory motion, or a combination of oscillatory-rotary motions to the lens-blank 19.

In order to grind the lens blank, the pins 25 are engaged into the apertures 23 thereby securing the rigid surface 21 and lens blank 19 against the abrasive impregnated pad. The oscillatory machine is then turned on and the lens blank 19 is oscillated (or oscillated and rotated simultaneously) against the abrasive impregnated pad 1 (In some instances an oscillatory motion may be imparted to the iron block 13 while lateral motion is imparted to the lens blank 19). In order to prevent overheating of the lens blanks, one or more streams of cooling water are passed over the abrasive impregnated pad and are distributed thereover.

After the desired predetermined degree of curvature in the lens blank has been achieved, the oscillatory machine is turned off, the pins 25 are disengaged from their respective apertures 23 and the lens blank 19 removed and subjected to subsequent polishing operation to further refine its surface. Once used, the abrasive impregnated pad is removed and another pad is used for grinding another lens blank.

As it was previously pointed out, the use of an abrasive impregnated pad in accordance with this invention obviates the need for using an abrasive slurry during the grinding operation. In addition, grinding of a lens blank to a predetermined curvature and surface smoothness can be effected in a matter of seconds in contrast to most prior art methods which require several minutes for achieving the same degree of curvature and smoothness in the lens blank. This is a matter of significant commercial and practical importance for the industrial manufacturers of finished lenses.

Also, while the abrasive impregnated pad has heretofore been described with certain degrees of particularities and rather precise geometrical configuration, it is obvious that some modifications may be made which nevertheless fall within the purview and contemplation of this invention. For example, other geometrical configurations for the pad (e.g., circular, rectangular) are contemplated with or without radially extending channels cut through their area, although the configuration described herein and illustrated in the drawings insure proper and smooth fitting of the pad over the working surface, and provides for adequate distribution of the cooling medium in order to prevent overheating and damage to the lens blanks during the grinding operation.

What is claimed is:

1. A pad for grinding lens blanks comprising a relatively porous and substantially water-resistant pliable sheet adapted to conform to the curved surface of a working tool, an adhesive coating on the underside of said pad for adhesively securing said pad to the surface of said tool and an abrasive surface on the other side thereof, a plurality of radially extending channels cut through the area of said pad, said radially extending channels being defined by parallel radial sides extending from the periphery of said pad toward the center thereof and an arched segment joining the inner ends of said radial sides.

2. A pad as in claim 1 wherein said arched segment is of generally circular configuration having a diameter larger than the width of said radially extending channel.

* * * * *